US007384164B2

(12) United States Patent
Yu

(10) Patent No.: US 7,384,164 B2
(45) Date of Patent: Jun. 10, 2008

(54) ILLUMINATED LIQUID DISPENSING CONTAINER

(76) Inventor: Sun Yu, 2850 Coolidge Hwy., Berkley, MI (US) 48072

( * ) Notice: Subject to any disclaimer, the term of this patent is extended or adjusted under 35 U.S.C. 154(b) by 58 days.

(21) Appl. No.: 10/942,370

(22) Filed: Sep. 16, 2004

(65) Prior Publication Data

US 2005/0056663 A1 Mar. 17, 2005

Related U.S. Application Data

(60) Provisional application No. 60/503,288, filed on Sep. 16, 2003.

(51) Int. Cl.
*F21V 33/00* (2006.01)

(52) U.S. Cl. ..... 362/101; 362/96; 362/276

(58) Field of Classification Search ..... 362/101, 362/96, 562, 154, 155, 183–185, 234, 253, 362/251, 276, 295, 394, 800, 802; 215/230
See application file for complete search history.

(56) References Cited

U.S. PATENT DOCUMENTS

| | | | | |
|---|---|---|---|---|
| 2,663,866 | A | 12/1953 | Simpson | 340/282 |
| 4,390,928 | A | 6/1983 | Runge | 362/101 |
| 4,922,355 | A | 5/1990 | Dietz et al. | 362/101 |
| 4,930,902 | A | 6/1990 | Yata et al. | 374/150 |
| 5,044,509 | A | 9/1991 | Petrosky et al. | 215/366 |
| 5,070,435 | A | 12/1991 | Weller | 362/101 |
| 5,211,699 | A | 5/1993 | Tipton | 362/101 |
| 5,662,406 | A | 9/1997 | Mattice et al. | 362/101 |
| 5,743,620 | A | 4/1998 | Rojas et al. | 362/101 |
| 5,785,407 | A | 7/1998 | Ratcliffe et al. | 362/101 |
| 5,842,763 | A | 12/1998 | Lakosky | 362/23 |
| 6,213,616 | B1 | 4/2001 | Chien | 362/84 |
| 6,254,247 | B1 * | 7/2001 | Carson | 362/101 |
| 6,305,817 | B1 | 10/2001 | Johnston et al. | 362/154 |
| 6,352,352 | B1 | 3/2002 | Schletterer et al. | 362/183 |
| 6,366,028 | B1 * | 4/2002 | Wener et al. | 362/202 |
| 6,511,196 | B1 | 1/2003 | Hoy | 362/101 |
| 6,527,402 | B1 * | 3/2003 | Borri | 362/86 |
| 2002/0000908 | A1 | 1/2002 | Burg, II et al. | 340/328 |
| 2002/0157292 | A1 | 10/2002 | Landers, Jr. et al. | 40/546 |
| 2002/0185388 | A1 | 12/2002 | Su | 206/217 |
| 2003/0081408 | A1 * | 5/2003 | Tai | 362/101 |

FOREIGN PATENT DOCUMENTS

| | | | |
|---|---|---|---|
| JP | 07271316 | A | 10/1995 |

* cited by examiner

*Primary Examiner*—Bao Q Truong
(74) *Attorney, Agent, or Firm*—Gifford, Krass, Sprinkle et al.

(57) ABSTRACT

A liquid dispensing container includes a transparent or translucent vial. A base is secured to the vial and contains a light source and a battery source. The light source being monochromatic or outputting multiple colors in sequence. A switch is provided for selectively forming electrical engagement between the light source and the battery source. A printed circuit board interspersed between the light source and the battery source affords optional subcircuits including a timer, step-up voltage, or step-down voltage capabilities, or light source output color modulation.

24 Claims, 2 Drawing Sheets

17
15
14
12
10
18
16
20
44
38
34
36
29
26
24
30
42
32
28
31
33
60
58
52
56
50

ILLUMINATED LIQUID DISPENSING CONTAINER

RELATED APPLICATION

This application claims priority of U.S. Provisional Patent Application Ser. No. 60/503,288 filed Sep. 16, 2003, which is incorporated herein by reference.

FIELD OF THE INVENTION

The present invention relates generally to a lighted liquid dispensing container and, more particularly, to a lighted liquid dispensing container having a light emitting diode directing illumination generally parallel to the liquid dispensing container walls.

BACKGROUND OF THE INVENTION

Bottles, and in particular bottles designed as perfume containers, afford a user with an added visual stimulus to accompany the tactile and olfactory aspects of perfume application. The added size and/or volume displacement of conventional illuminated perfume bottles has limited the acceptance of such bottles. U.S. Pat. No. 6,525,402 is representative thereof. Thus, there exists a need for an illuminated perfume bottle where the lighting components are compact and do not displace contents volume.

SUMMARY OF THE INVENTION

A liquid dispensing container includes a transparent or translucent vial. A base is secured to the vial and contains a light source and a battery source. The light source being monochromatic or outputting multiple colors in sequence. A switch is provided for selectively forming electrical engagement between the light source and the battery source. A printed circuit board interspersed between the light source and the battery source affords optional subcircuits including a timer, step-up voltage, or step-down voltage capabilities, or light source output color modulation.

DETAILED DESCRIPTION OF THE PREFERRED EMBODIMENTS

The present invention has utility as a liquid dispensing container affording enhanced user sensory stimulation. According to the present invention, a base or cap holder incorporates a light source, a battery source and switch circuitry for electrical communication therebetween. The illumination from the light source is projected along the length of the container alone, or through an optional sleeve. The present invention is ideally suited for use as a perfume bottle.

Figure 1:
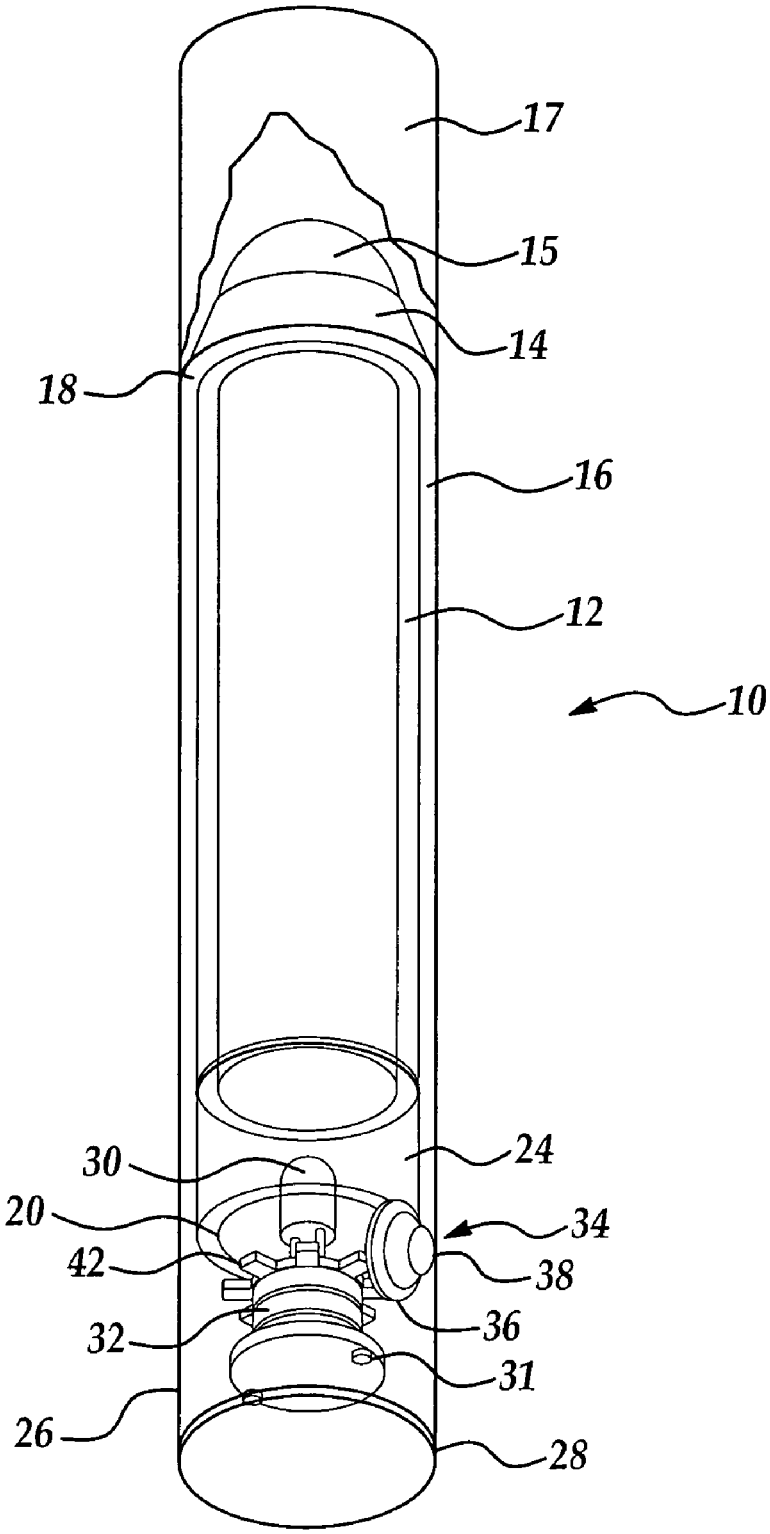
FIG. 1 is a perspective partial cutaway view of a preferred inventive embodiment.
Figures 2, 3:
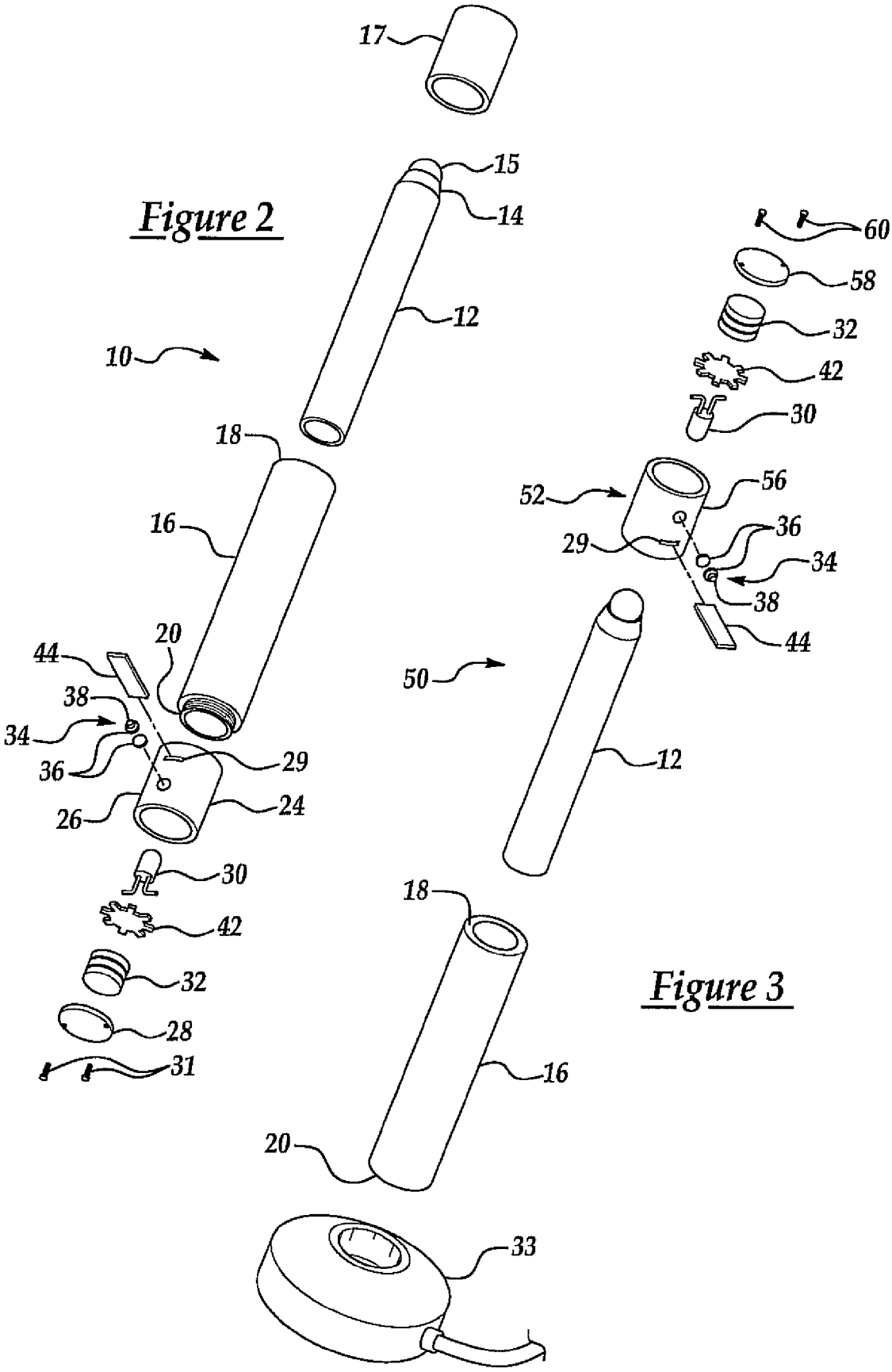
FIG. 2 is an exploded view of the inventive embodiment depicted in FIG. 1.
FIG. 3 is an alternate embodiment of the present invention wherein the illumination extends from the cap towards the bottle volume.

Referring now to FIGS. 1 and 2, an inventive liquid dispensing container is shown generally at 10. The container 10 includes a transparent or translucent vial 12 having a mouth 14. The vial 12 is formed of any material conventional to the art that is chemically unreactive to the intended contents therein. Transparent or translucent bottle materials illustratively include glass, acrylic, thermoplastics, of colorless or colored forms. While the vial 12 is depicted as cylindrical in shape with an aspect ratio between length and diameter of about six, it is appreciated that the vial in the present invention operatively is provided in a variety of shapes illustratively including rectilinear, ellipsoidal, polygonal and complex geometric cross sections. A vial 12 according to the present invention preferably has a mouth 14 terminating in a dispensing head selected based upon the nature of the liquid contained therein. Vial mouth heads illustratively include an atomizer spray nozzle and a roller ball head 15. Optionally, a sleeve 16 having a top 18 and a bottom 20 encompasses the vial 12. The sleeve 16, when present, is preferably formed from a conventional material in two dimensions sufficient to create an impact-resistant barrier to protect the encompassed vial 12. Materials from which inventive sleeve 16 is formed illustratively include acrylic, ABS, thermoplastics, and tempered glass. While a sleeve 16 inevitably provides some protection to an encompassed vial 12, the sleeve 16 also provides an additional light transmission media. Optionally, indicia are scored or stamped into the sleeve 16 or vial 12 to create a high optical contrast decorative or branding indicia. A cap 17 is provided to selectively seal the contents of the vial 12 against the external environment. A cap 17 secures to the vial 12 through conventional means illustratively including complementary threads and a stopper engaging the vial mouth 14.

A base holder 24 is defined by a sidewall 26 and a base bottom 28. The base holder 24 is secured to the distal portion of the vial 12 relative to the mouth 14 or alternatively, if a sleeve 16 is present, the base holder 24 is optionally secured thereto. The base holder 24 is secured to a vial 12, or sleeve 16 by conventional means illustratively including complementary threads, contact adhesives, and a friction fitting. A light source 30 is located within the base holder 24.

The light source 30 includes an incandescent bulb, a light emitting diode, and a phosphorescent emitter element. Preferably, the light source is a light emitting diode (LED). The light source of the present invention has white, red, orange, yellow, green, blue and ultraviolet emissions. While the present invention is described with respect to a single light source, it is appreciated that multiple light sources are readily incorporated herein. When multiple light sources are present, it is appreciated that two or more light sources having different emission characteristics can be controlled to afford different illumination colors within an inventive liquid dispensing container.

In still another inventive embodiment, the light source 30 has a variable color output provided by a light emitting diode having a multiple color output or at least two light emitting diodes where the first light emitting diode has a first single color output and a second light emitting diode where the first color output differs from the second color output. The variable color light source optionally includes a third light emitting diode having a third color output, where the third color output varies from the second color output. The variable color output of the light source can be varied automatically through the printed circuit board 42 which automatically cycles the light source color upon initial switch activation and continues to cycle the colors until switch deactivation. Alternatively, the light source color is varied with each depression of the switch 34.

Preferably, the light source is oriented to direct a majority of the emission therefrom into the vial 12 via a vial bottom 13.

The base housing 24 also has located therein a battery source 32 characterized by an output voltage capable to power the light source 30. While it is recognized that any number of single cell or battery cell stacks are operative herein, in a preferred embodiment, a button-type battery cell is used in an inventive container. In a particular preferred embodiment, a high storage capacity lithium battery is coupled with a light emitting diode light source.

In another preferred embodiment the battery source 32 is a rechargeable battery and the base housing is adapted to couple with a conventional outlet power supplied consumer electronic recharger station 33. A recharger preferably operating through induction to recharge the battery source 32.

The base holder bottom 28 is secured to the base holder 24 in order to enclose the light source 30 and the battery source 32 therein. The base holder bottom 28 is secured to the base holder 24 by conventional means illustratively including complementary threads, threaded fasteners, adhesives, and fusion. Preferably, a fastener 31 secures the bottom 28 to the holder 24.

A switch 34 is provided for selectively forming an electrical engagement between the light source 30 and the battery source 32. The switch 34 is intended for manual activation. Preferably, the switch 34 is located in the base holder sidewall 26 although it is recognized that the switch 34 is also operative when located in the base holder bottom 28.

While the switch 34 is appreciated to be any conventional electrical switch, in a preferred embodiment, the switch 34 is a dome switch in which a concave conductive metal element 36 is depressed into selective contact so as to form an electrical circuit between the light source 30 and the battery source 32. Preferably, when the switch 34 is a dome switch, the metal element 36 has a protective elastomeric cover 38.

Alternatively, the switch 34 is positioned such that the light source is deactivated upon an interface being formed between a cap and the vial.

In still another alternate embodiment, the switch 34 is a switch sensitive to the motion of an inventive liquid dispensing container.

It is appreciated that the relationship between a sleeve 16 and the base holder 24 is variable in that the sleeve 16 optionally encompasses at least a portion of the base holder sidewall 26. In an extreme instance, the sleeve 16 and the base holder bottom 28 are coterminous. In an instance where the sleeve 16 encompasses at least a portion of the base holder sidewall 26, a sidewall mounted switch 34 is optionally positioned to protrude through an aperture in the sleeve 16.

In a preferred embodiment, the base holder 24 also incorporates a printed circuit board 42 in electrical communication with the light source 30. The printed circuit board 42 includes a timer circuit (not shown) to limit the duration of light source emission subsequent to switch activation. A time limit circuit is particularly effective in maintaining battery source longevity in instances where an inventive container is carried by an individual on their person or in a carrier such as a purse. In such instances, inadvertent illumination is likely to occur thereby depleting the battery source. Still more preferably, the base holder 24 has an opening 29 adapted to receive an electrically non-conductive strip 44 therethrough. The strip 44 is intended to mechanically prevent formation of an electrical circuit between the light source 30 and the battery source 32. The strip 44 is intended to prevent inadvertent illumination during shipment and/or storage. As a result, a user of an inventive container withdraws the non-conductive strip 44 upon beginning container usage. Optionally, the non-conductive strip 44 is replaced to prevent inadvertent illumination during subsequent transportation.

Optionally, the printed circuit board 42 modifies the battery source output voltage to either increase or decrease the battery output voltage to more closely correspond to the light source activation voltage. Preferably, the modified battery output voltage is within 20 excess percent of the light source activation voltage. More preferably, the modified output voltage is within 10 excess percent of the light source activation output voltage. In instances where a light emitting diode is the light source, it is often the case that the light emitting diode activation voltage is greater than that of a single dry cell or lithium battery output voltage and as such multiple batteries operating in series are required to drive the light emitting diode. Additional batteries increase both the cost and weight of an inventive liquid dispensing container. As such, the use of a conventional transformerless voltage step-up circuit is employed to increase the battery output voltage to at least that of the LED activation voltage. Typically, printed circuit board circuitry increases the battery output voltage by a factor of between 1.6 and 3 in order to provide sufficient voltage to drive a light emitting diode at its activation voltage or above, Preferably, printed circuit board circuitry has as an input the battery source output voltage and modifies the battery output voltage to within 20 percent of the light source activation voltage.

In an alternate embodiment shown in FIG. 3, an inventive liquid dispensing container is shown generally at 50 where like numerals correspond to those elements previously described with respect to FIGS. 1 and 2. In the inventive container 50, a vial 12 has a mouth 14. An illuminating cap 52 has a sidewall 56 and a top 58. The illuminating cap 52 encloses a light source 30, a battery source 32 and a switch 34. Preferably, the switch 34 is a dome switch including a metal element 36 and an elastomeric cover 38. The top 58 is preferably secured to the remainder of the illuminating cap 52 through the use of a threaded fastener 60. Preferably, intermediate between the light source 30 and the battery source 32 is a printed circuit board 42. Optionally, the illuminating cap 52 has an opening 59 therein. The opening 59 is adapted to receive a non-conducting strip 44 that precludes illumination while the strip 44 mechanically blocks the formation of electric communication between the light source 30 and the battery source 32.

Preferably, the mouth 14 has a dispensing head illustratively including an atomizer spray nozzle or a ball head 15 coupled to the mouth 14 of the vial 12.

In a particularly preferred embodiment, the light source 30 within the illuminating cap 52 is an ultraviolet emitting light emitting diode (UV LED). Activation of the switch 34 in the preferred embodiment creates ultraviolet light illumination of the vial head for a period of time sufficient to sterilize the dispensing head. The biocidal ultraviolet emission entering the vial 12 is largely blocked from passing into the exterior of an inventive container by the glass or plastic material of which the vial 12 is formed. Optionally, a sleeve 16, or a transparent or translucent outer vial including sides and a bottom (not shown) encompasses the vial. The sleeve 16 or outer vial is appreciated to further block ultraviolet light transmission from an inventive container.

Patents and publications mentioned in the specification are indicative of the levels of those skilled in the art to which the invention pertains. These patents and publications are incorporated herein by reference to the same extent as if each individual patent or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A liquid dispensing container comprising:

a transparent or translucent vial having a mouth;

a base having a sidewall and a bottom;

a light source located within said base and having an activating voltage and an output color;

a base housing;

a button-type battery source located within said base housing and having a battery output voltage; and a printed circuit board modifying an input the battery source output voltage to a battery output voltage of within 20% of the light source activation voltage.

2. The container of claim 1 wherein said circuitry increases the battery output voltage.

3. The container of claim 2 wherein said circuitry increases the battery output voltage by a factor of between 1.6 and 3.

4. The container of claim 1 wherein said light source is a light emitting diode.

5. The container of claim 1 wherein the light source emits a plurality of output colors.

6. The container of claim 1 further comprising a spray nozzle attached to the mouth of said vial.

7. The container of claim 1 further comprising a cap overlying the mouth of said vial and forming an interface with said vial.

8. The container of claim 7 further comprising a switch that deactivates the light source upon the interface being formed between said cap and said vial.

9. The container of claim 1 further comprising a switch for selectively engaging said printed circuit board.

10. The container of claim 9 wherein said switch is engaged manually.

11. The container of claim 10 wherein said switch is located in the base sidewall.

12. The container of claim 9 wherein said switch is engaged by motion of the container.

13. The container of claim 1 wherein said battery source is rechargeable and said base is adapted to couple to a recharger station.

14. A liquid dispensing container comprising:

a transparent or translucent vial having a mouth and a vial bottom;

a transparent or translucent impact-resistant sleeve encompassing said vial;

a base having a sidewall and a bottom;

a light source projecting predominantly through the vial bottom;

a battery source located within said base; and a switch extending from the sidewall of said base for selectively forming an electrical engagement between said light source and said battery source.

15. The container of claim 14 wherein light source color varies automatically.

16. The container of claim 14 wherein the light source color varies with switch activation.

17. The container of claim 14 further comprising a third light emitting diode having a third color output the third color output varying from the second color output.

18. A liquid dispensing container comprising:

a transparent or translucent vial having a mouth and a vial bottom;

a base having a sidewall and a bottom;

a light source projecting predominantly through the vial bottom;

a battery source located within said base;

a switch extending from the sidewall of said base for selectively forming an electrical engagement between said light source and said battery source; and circuitry that increases the battery output voltage to within 20% of the light source activation voltage.

19. The container of claim 18 wherein said circuitry increases the battery output voltage by a factor of between 1.6 and 3.

20. The container of claim 14 wherein the light source emits a plurality of output colors.

21. The container of claim 14 further comprising a spray nozzle attached to the mouth of said bottle.

22. The container of claim 14 further comprising a cap overlying the mouth of said vial and forming an interface with said vial.

23. The container of claim 14 wherein said switch is engaged manually.

24. The container of claim 14 wherein said battery source is rechargeable and said base is adapted to couple to a recharger station.

* * * * *